US010077748B2

(12) United States Patent
Benson et al.

(10) Patent No.: US 10,077,748 B2
(45) Date of Patent: Sep. 18, 2018

(54) FUEL INJECTOR FOR COMMON RAIL

(71) Applicant: Cummins Inc., Columbus, IN (US)

(72) Inventors: Donald J. Benson, Columbus, OH (US); Ahmad M. Sabri, Columbus, IN (US); Hanumantharao Konakanchi, Columbus, IN (US)

(73) Assignee: Cummins Inc., Columbus, IN (US)

( * ) Notice: Subject to any disclaimer, the term of this patent is extended or adjusted under 35 U.S.C. 154(b) by 93 days.

(21) Appl. No.: 14/580,820

(22) Filed: Dec. 23, 2014

(65) Prior Publication Data

US 2016/0177900 A1 Jun. 23, 2016

(51) Int. Cl.
*F02M 55/00* (2006.01)
*F02M 63/00* (2006.01)
(Continued)

(52) U.S. Cl.
CPC ..... *F02M 55/002* (2013.01); *F02M 47/027* (2013.01); *F02M 63/0012* (2013.01); *F02M 63/0225* (2013.01)

(58) Field of Classification Search
CPC ..... F02M 55/002; F02M 47/027; F02M 63/0012; F02M 63/0225
(Continued)

(56) References Cited

U.S. PATENT DOCUMENTS 5,156,132 A * 10/1992 Iwanaga ..... F02M 47/027 123/447
5,694,903 A * 12/1997 Ganser ..... F02M 45/12 123/467
(Continued)

FOREIGN PATENT DOCUMENTS

DE 102008002417 * 12/2009 ..... F02M 51/06
DE 10 2013 113 892 6/2014
(Continued)

OTHER PUBLICATIONS

International Search Report and Written Opinion for PCT Application No. PCT/US2015/067465, issued Mar. 11, 2016, 7 pgs.

*Primary Examiner* — Chee-Chong Lee
(74) *Attorney, Agent, or Firm* — Faegre Baker Daniels LLP

(57) ABSTRACT

A fuel injector, comprising an injector body having a longitudinal axis, an injector cavity, an injector orifice at a distal end of the injector cavity, and an inlet conduit configured to supply fuel into the injector cavity, a nozzle valve in the injector cavity, a drain circuit configured to drain fuel from the injector cavity to a low pressure drain, a pilot valve in flow communication with the drain circuit, a chamber housing having an inlet passage to receive fuel from the injector cavity, a return port in flow communication with the pilot valve to drain fuel to the drain circuit, and an abutting surface surrounding the return port, and a control body slidably disposed in the chamber housing, the control body having, a distal end, a proximal end, and a longitudinal axis parallel with the injector body longitudinal axis, a first depression at the distal end defining a first control chamber in which one end of the nozzle valve is guided, a second depression at the proximal end defining a second control chamber in flow communication with the return port, and an annular seal disposed radially of the second depression having a first diameter at an inner surface and a second diameter at an outer surface, wherein the first diameter is smaller than the second diameter.

23 Claims, 3 Drawing Sheets

(51) Int. Cl.
*F02M 47/02* (2006.01)
*F02M 63/02* (2006.01)

(58) Field of Classification Search
USPC ..... 239/5
See application file for complete search history.

(56) References Cited

U.S. PATENT DOCUMENTS 5,771,865 A * 6/1998 Ishida ..... F02M 45/04 123/300
5,862,793 A * 1/1999 Jay ..... F02M 43/04 123/25 C
5,979,410 A * 11/1999 Grieshaber ..... F02M 43/04 123/300
6,067,955 A * 5/2000 Boecking ..... F02M 45/04 123/299
6,085,719 A * 7/2000 Heinz ..... F02M 45/08 123/300
6,293,254 B1 9/2001 Crofts et al.
6,997,166 B2 2/2006 Stringfellow
8,113,176 B2 2/2012 Rossignol et al.
8,186,609 B2 5/2012 Rapp et al.
8,226,018 B2 7/2012 Magel
8,544,767 B2 10/2013 Adachi et al.
8,573,186 B2 11/2013 Rettich et al.
8,602,328 B2 12/2013 Adachi et al.
8,695,892 B2 4/2014 Kobane et al.
8,708,250 B2 4/2014 Yamashhita et al.
2002/0056761 A1 5/2002 Boecking
2006/0097067 A1 5/2006 Buehler et al.
2007/0283930 A1 12/2007 Jung et al.
2010/0071665 A1 3/2010 Rossignol et al.
2010/0176222 A1 7/2010 Straub
2010/0288239 A1 11/2010 Morris et al.
2011/0198418 A1 8/2011 Kobane et al.
2011/0233309 A1 9/2011 Fukuta et al.
2011/0240768 A1 10/2011 Fujikake et al.
2012/0103308 A1 5/2012 Hefler et al.
2013/0153686 A1 6/2013 Keeler
2014/0174405 A1 6/2014 Adachi
2014/0252108 A1 9/2014 Cavanagh

FOREIGN PATENT DOCUMENTS

EP 1 541 860 7/2007
EP 2 628 938 8/2013
EP 2 735 725 5/2014

* cited by examiner

FUEL INJECTOR FOR COMMON RAIL

TECHNICAL FIELD

The present disclosure relates generally to a fuel injector having a control body which effectively reduces the pilot valve parasitic drain flow quantity while increasing fuel efficiency.

BACKGROUND

The existing fuel injectors for common rail applications have multiple problems including, high pilot valve parasitic drain quantity inefficiency. High pilot valve parasitic drain quantity inefficiency negatively affects the fuel system's performance, including fuel economy, injector failure mechanisms, and heat rejection to tank. Therefore, there remains a need in the art for apparatuses, methods and systems of fuel injection that reduce pilot valve parasitic drain quantity, thereby improving efficiency and overall operating conditions of the engine.

SUMMARY

In one embodiment, the present disclosure provides a fuel injector comprising, an injector body having a longitudinal axis, an injector cavity, an injector orifice at a distal end of the injector cavity, and an inlet conduit configured to supply fuel into the injector cavity, a nozzle valve in the injector cavity, a drain circuit configured to drain fuel from the injector cavity to a low pressure drain, a pilot valve in flow communication with the drain circuit, a chamber housing having an inlet passage to receive fuel from the injector cavity, a return port in flow communication with the pilot valve to drain fuel to the drain circuit, an abutting surface surrounding the return port, and a control body slidably disposed in the chamber housing, the control body having, a distal end, a proximal end, and a longitudinal axis parallel with the injector body longitudinal axis, a first depression at the distal end defining a first control chamber in which one end of the nozzle valve is guided, a second depression at the proximal end defining a second control chamber in flow communication with the return port, and an annular seal disposed radially of the second depression having a first diameter at an inner surface and a second diameter at an outer surface, wherein the first diameter is smaller than the second diameter. According to one aspect of this embodiment, the control body further includes a throttled passage extending from the distal end to the proximal end connecting the first control chamber with the second control chamber. According to another aspect of this embodiment, the throttled passage further includes a control body orifice configured to control a closing rate of the control body and a closing rate of the nozzle valve. According to yet another aspect of this embodiment, the control body further includes a protrusion on the outer surface configured to control axial movement of the control body along the injector body. In one aspect of this embodiment, the chamber housing is disposed between a nozzle sleeve, the nozzle valve, and the pilot valve, the chamber housing being positioned in abutment against the nozzle sleeve restricting fuel flow, and the control body having a close sliding fit with an inside surface of the nozzle sleeve. In yet another aspect of this embodiment, the control body defines an annular guiding clearance at the distal end of the control body between the outer surface of the control body and an inner surface of the chamber housing. According to another aspect of this embodiment, an inner surface of the chamber housing further includes a shoulder below the protrusion of the control body and the inlet passage, the shoulder configured to control the movement of the control body along the longitudinal axis. Another aspect of this embodiment further includes a spring positioned in the chamber housing between the protrusion and the shoulder. According to yet another aspect of this embodiment, the control body has a third diameter at the distal end which is greater than the second diameter. According to another aspect of this embodiment, the inlet passage is throttled.

In another embodiment of the present disclosure, a fuel system comprising, a fuel tank communicating with a high pressure generating module, a fuel injector, a fuel supply channel extending between the high pressure generating module and the fuel injector, and a return channel extending between the fuel injector and the fuel tank, wherein the fuel injector includes an injector body having a longitudinal axis, an injector cavity, an injector orifice at a distal end of the injector cavity, and an inlet conduit configured to supply fuel into the injector cavity, a nozzle valve in the injector cavity, a drain circuit configured to drain fuel from the injector cavity to a low pressure drain, a pilot valve in flow communication with the drain circuit, a chamber housing having an unrestricted inlet passage to receive fuel from the injector cavity, a return port in flow communication with the pilot valve to drain fuel to the drain circuit, and an abutting surface surrounding the return port, and a control body slidably disposed in the chamber housing, wherein the control body having a distal end, a proximal end, and a longitudinal axis parallel with the injector body longitudinal axis, a first depression at the distal end defining a first control chamber in which one end of the nozzle valve is guided, a second depression at the proximal end defining a second control chamber in flow communication with the return port, and an annular seal disposed radially of the second depression having a first diameter at an inner surface and a second diameter at an outer surface, wherein the first diameter is smaller than the second diameter. According to one aspect of this embodiment, the control body further includes a throttled passage extending from the distal end to the proximal end connecting the first control chamber with the second control chamber.

In another embodiment, a method is provided comprising energizing a fuel injector pilot valve thereby causing a sealing element to open resulting in a pressure differential between a first control chamber and an injector cavity to a level which enables a nozzle valve to move upward toward an open position and begin a fuel injection event, de-energizing the pilot valve thereby causing the sealing element to close while the nozzle valve continues to move upward pressurizing a second control chamber to a level which enables a control body to open relative to the sealing element and permit fuel to flow from the injector cavity to the second control chamber, ending the fuel injection event when the nozzle valve closes in response to a pressure differential between the first control chamber, the second control chamber, and the injector cavity, and closing the control body in response to a drop in pressure differential between the injector cavity and the second control chamber. According to one aspect of this embodiment, applying a biasing force to the control body to open relative to the sealing element by providing an annular seal at a proximal end of the control body.

In yet another embodiment of the present disclosure, a fuel injector is provided comprising an injector body having a longitudinal axis, an injector cavity, an injector orifice at a distal end of the injector cavity, and an inlet conduit configured to supply fuel into the injector cavity, a nozzle valve in the injector cavity, a drain circuit configured to drain fuel from the injector cavity to a low pressure drain, a pilot valve in flow communication with the drain circuit, a chamber housing having an inlet passage to receive fuel from the injector cavity, a return port in flow communication with the pilot valve to drain fuel to the drain circuit, and an abutting surface surrounding the return port, and a control body slidably positioned in the chamber housing. According to one aspect of this embodiment, a control body slidably disposed in the chamber housing, the control body having, a distal end, a proximal end, and a longitudinal axis parallel with the injector body longitudinal axis, a first depression at the distal end defining a first control chamber in which one end of the nozzle valve is guided, a second depression at the proximal end defining a second control chamber in flow communication with the return port, and an annular seal disposed radially of the second depression having a first diameter at an inner surface and a second diameter at an outer surface, wherein the first diameter is smaller than the second diameter. According to another aspect of this embodiment, the control body further includes a throttled passage extending from the distal end to the proximal end connecting the first control chamber with the second control chamber. According to yet another aspect of this embodiment, the throttled passage further includes a control body orifice configured to control a closing rate of the control body and an opening rate of the nozzle valve. According to one aspect of this embodiment, the control body further includes a protrusion on the outer surface configured to control axial movement of the control body along the injector body. According to another aspect of this embodiment, the chamber housing is disposed between a nozzle sleeve, the nozzle valve, and the pilot valve, the chamber housing being positioned in abutment against the nozzle sleeve restricting fuel flow, and the control body having a close sliding fit with an inside surface of the nozzle sleeve. According to yet another aspect of this embodiment, the control body defines an annular guiding clearance at the distal end of the control body between the outer surface of the control body and an inner surface of the chamber. In yet another aspect, an inner surface of the chamber housing further includes a shoulder below the protrusion of the control body and the inlet passage, the shoulder configured to control the movement of the control body along the longitudinal axis. Another aspect of this embodiment further including a spring positioned in the chamber between the protrusion and the shoulder. In yet another aspect, the inlet passage is throttled.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
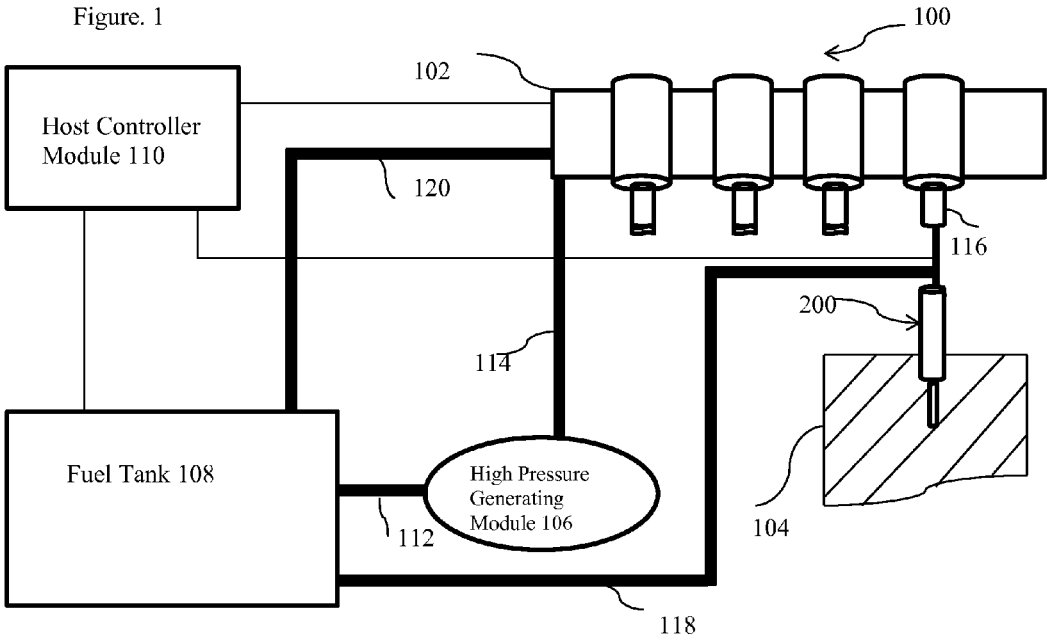
FIG. 1 is a block diagram of an exemplary system in which a fuel injector can be implemented according to present disclosure.

Although the drawings represent embodiments of the various features and components according to the present disclosure, the drawings are not necessarily to scale and certain features may be exaggerated in order to better illustrate and explain the present disclosure. The exemplification set out herein illustrates embodiments of the disclosure, and such exemplifications are not to be construed as limiting the scope of the disclosure in any manner.

DETAILED DESCRIPTION OF EMBODIMENTS

For the purpose of promoting an understanding of the principles of the disclosure, reference will now be made to the embodiments illustrated in the drawings, which are described below. It will nevertheless be understood that no limitation of the scope of the disclosure is thereby intended. The disclosure includes any alterations and further modifications in the illustrated device and described methods and further applications of the principles of the disclosure, which would normally occur to one skilled in the art to which the disclosure relates. Moreover, the embodiments were selected for description to enable one of ordinary skill in the art to practice the disclosure.

Referring now to FIG. 1, a system 100 according to one embodiment of the present disclosure is depicted as including a common rail 102, a fuel injector 200, a combustion chamber 104 (partially shown), a high pressure generating module 106, a fuel tank 108, and a host controller module 110. Host controller module 110 may be any of a variety of general or special purpose computing devices, and generally includes a microcontroller unit (not shown) configured to send signals to the fuel injector 200, common rail 102, and fuel tank 108. Microcontroller unit generally may include a processor, a memory, and peripherals. The microcontroller unit may be programmable or non-programmable. Host controller module 110 receives feedback from various sensors (not shown) in the system 100 and adjusts pressure and fuel injection accordingly.

Figure 2:
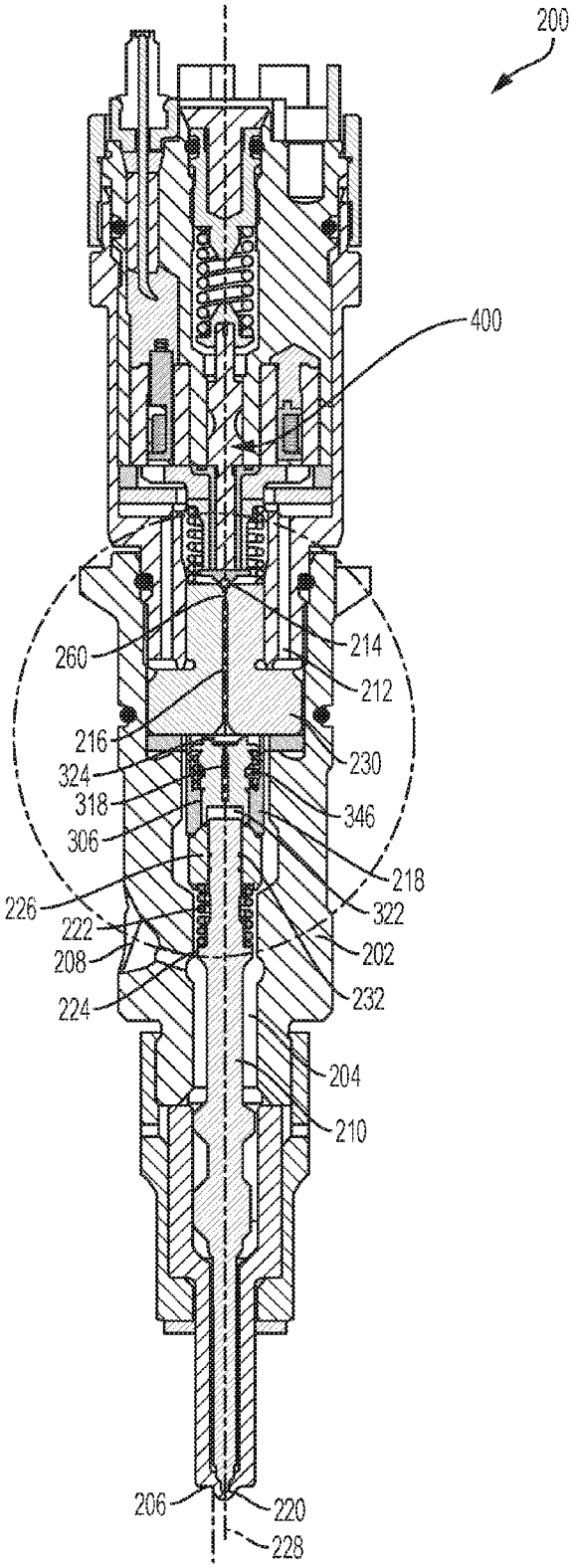
FIG. 2 is a sectional, side view showing the fuel injector of FIG. 1.

Still referring to FIG. 1, the fuel tank 108 is connected to high pressure generating module 106 with a fuel line 112 and supplies fuel to the high pressure generating module 106. Fuel line 112 may include a pressure control valve configured to control the pressure of fuel supplied to the high pressure generating module 106. Fuel line 112 may further include other components, for example, pressure pump, and filters. High pressure generating module 106 is attached to common rail 102 by a fuel line 114 and supplies high pressure fuel to the common rail 102. High pressure generating module 106 increases the pressure of the fuel supplied by the fuel tank 108 to supply fuel to the common rail 102. High pressure generating module 106 is attached to and driven by the engine (not shown) in a manner known in the art. Host controller module 110 regulates pressure in high pressure generating module 106 according to techniques known in the art. Common rail 102 is typically an elongated pipe shaped member having a plurality of branches 116. Each branch 116 is connected to a fuel injector 200. Generally, number of branches 116 corresponds to number of cylinders per bank of the engine. Common rail 102 is typically a high pressure fuel accumulator which stores fuel and passes it into fuel injector 200 for fuel injection events. Common rail 102 may include a rail sensor (not shown) to monitor system pressure. Common rail 102 may further include a pressure regulator (not shown) that maintains fuel pressure in the common rail 102. Any excess fuel in common rail 102 is returned to the fuel tank 108 though a fuel line 120. Fuel injector 200 and the high pressure generating module 106 are connected by a fuel line 118 forming a part of a drain circuit 212 (FIG. 2). Fuel line 118 supplies unused fuel from the fuel injector 200 to the fuel tank 108.

Figure 3:
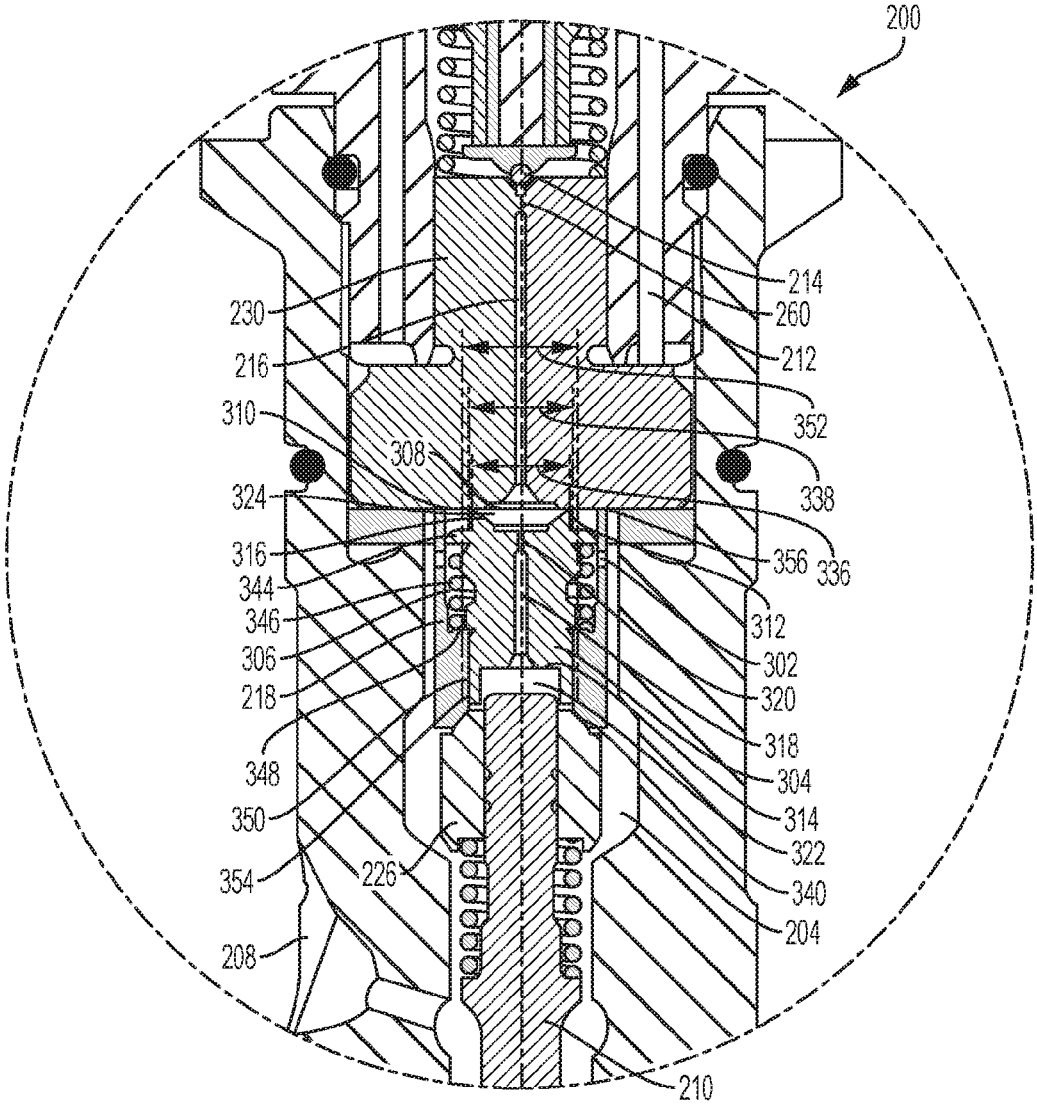
FIG. 3 is an enlarged sectional, side view of a portion of the fuel injector of FIG. 2.

Referring now to FIG. 2, the fuel injector 200 is depicted as including an injector body 202, an injector cavity 204, an injector orifice 206, an inlet conduit 208, a nozzle valve 210, a drain circuit 212, a pilot valve 214, and a chamber housing 218. Injector body 202 is generally an elongated cylindrical body which forms injector cavity 204. Injector cavity 204 receives high pressure fuel from common rail 102 through inlet conduit 208. The injector body 202 further includes a longitudinal axis 228, and injector orifice 206 in flow communication with the combustion chamber 104 (partially shown in FIG. 1). Nozzle valve 210 is disposed in injector cavity 204 and moves reciprocally between a closed position (as shown) and an open position (not shown). In the closed position, the nozzle valve 210 sits on a nozzle seat 220 restricting fuel flow from nozzle cavity 204 into combustion chamber 104. In the open position, the nozzle valve 210 moves upward along longitudinal axis 228 such that fuel flows through injector orifice 206 into combustion chamber 104. Injector 200 further includes a nozzle sleeve 226 disposed in the injector cavity 204. Nozzle sleeve 226 is generally cylindrical in shape having a bore 232 for receiving a proximal end of the nozzle valve 210. An outer diameter of nozzle valve 210 and an inner diameter of nozzle sleeve 226 are sized relative to one another to create a close sliding fit. Although nozzle sleeve 226 and chamber housing 218 are shown to be two individual pieces, chamber housing 218 and nozzle sleeve 226 may be constructed as a unitary construct, or of a plurality of individual pieces assembled together. A nozzle spring 222 is positioned in injector cavity 204 with one end in abutment with a protrusion 224 on the nozzle valve 210, and another end in abutment with nozzle sleeve 226, so as to permit nozzle spring 222 to bias nozzle valve 210 into the closed position (as shown). The proximal end of nozzle valve 210 extends through bore 232 and is exposed to fuel pressure of a first control chamber 322 (FIG. 3). Injector 200 also includes a support 230 which includes a throttled return passage 216 extending along longitudinal axis 228 for draining fuel into low pressure drain circuit 212. In the open position, throttled return passage 216 connects low pressure drain circuit 212 with a high pressure injector circuit. High pressure injector circuit includes throttled return passage 216, and injector cavity 204. Throttled return passage 216 includes a return passage orifice 260 for controlling an opening rate and closing rate of the nozzle valve 210. Size, shape, and orientation of return passage orifice 260 may vary. As a result, opening rate of the nozzle valve 210 may also vary. Drain circuit 212 is in flow communication with the fuel tank 108 through fuel line 118 (shown in FIG. 1). The injection control valve 400 shown in FIG. 2 may include any conventional actuator assembly capable of selectively controlling the movement of pilot valve 214. For example, injection control valve 400 may include a conventional solenoid actuator as shown in FIG. 2, or alternatively, a piezoelectric or magnetostrictive type actuator assembly.

Still referring to FIG. 2, chamber housing 218 is positioned in the injector cavity 204, between nozzle valve 210 and a support 230, for controlling the movement of nozzle valve 210 between the closed position and the open position and then back to the closed position so as to define an injection event during which fuel flows through injector orifice 206 into combustion chamber 104. Chamber housing 218 has a longitudinal axis parallel with the injector body longitudinal axis 228.

Referring now to FIG. 3, an expanded cross sectional view of injector 200 is depicted showing chamber housing 218 as including a first annular abutting surface 356, a second annular sealing surface 340, an inlet passage 302, a control body cavity 306, a return port 308, an abutting surface 310, and a control body 304. Chamber housing 218 is generally an elongated cylindrical body which forms control body cavity 306. Fuel flows from injector cavity 204 into the control body cavity 306 through inlet passage 302 as pressure drops in the control body cavity 306. Inlet passage 302 may be throttled passage having an orifice (not shown). First annular abutting surface 356 extends annularly around a proximal end of chamber housing 218 for continuous sealing against support 230. Second annular sealing surface 340 extends annularly at a distal end for continuous clearance sealing against nozzle sleeve 226. Return port 308 opens in abutting surface 310 at proximal end of the chamber housing 218 for draining fuel into the drain circuit 212. Control body 304 is disposed in control body cavity 306 and slides longitudinally along longitudinal axis 228 between a closed position (as shown) and an open position (not shown).

Still referring to FIG. 3, control body 304 further includes an annular seal 312, a first depression 314, a second depression 316, and a throttled passage 318 extending between the depressions. Throttled passage 318 further includes an orifice 320 for controlling an opening rate of the nozzle valve 210, a closing rate of the nozzle valve 210, and a closing rate of the control body 304 in the manner described below. Size, shape, and orientation of throttled passage 318 may vary. As a result, opening and closing rate of the nozzle valve 210, and closing rate of the control body 304 may also vary. First depression 314 is disposed at a distal end of control body 304 forming a first control chamber 322 guiding a proximal end of the nozzle valve 210. The shape of first depression 314 generally matches a shape of the guided portion of the nozzle valve 210, such that the two surfaces never directly contact one another. Second depression 316 is disposed at a proximal end of control body 304 forming a second control chamber 324 where return port 308 opens. Second depression 316 may have a conical shape or any other shape. Throttled passage 318 fluidly connects first control chamber 322 to second control chamber 324 such that as pressure varies between the two chambers, fuel flows from a high pressure chamber to a low pressure chamber through throttled passage 318. Annular seal 312 of control body 304 seals against support 230 when control body 304 is in the closed position (as shown). Annular seal 312 has a first diameter 336 (inner diameter) and a second diameter 338 (outer diameter). First diameter 336 is smaller than second diameter 338. In one embodiment, the annular seal 312 may only have one diameter: second diameter 338. Control body 304 further includes a protrusion 344 on its outer surface at the proximal end. An inner surface of chamber housing 218 further includes a shoulder 348 below the protrusion 344 and inlet passage 302. A spring 346 is positioned between protrusion 344 and shoulder 348 to bias control body 304 into the closed position (as shown). Control body 304 is designed such that a third diameter 352 (outer), at distal end, is smaller than the inner diameter of cavity wall 354 of chamber housing 218 within which control body 304 is positioned. As a result, an annular guiding clearance 350 is formed along the axial length of control body 304 sufficient in size to permit control body 304 to move along longitudinal axis 228 due to, for example, high pressure forces in first control chamber 322 and second control chamber 324, and biasing of spring 346. Furthermore, second diameter 338 is smaller than third diameter 352. It should be understood that while various components are described hereinabove as positioned along longitudinal axis 228, in certain embodiments, these may be positioned differently without affecting implementation of the present disclosure.

Referring now back to FIG. 2, with injection control valve 400 de-actuated, pilot valve 214 is in a closed position against support 230, thereby blocking drain flow through throttled return channel 216 into drain circuit 212. As a result, the fuel pressure in the inlet conduit 208, nozzle cavity 204, throttled return channel 216, control body cavity 306, first control chamber 322, and second control chamber 324 is the same. With the fuel pressure in first control chamber 322 being same as the fuel pressure in nozzle cavity 204, the fuel pressure forces acting on nozzle valve 210 in combination with the biasing force of nozzle spring 222, keeps the nozzle valve 210 in closed position blocking fuel flow through injector orifices 206. Additionally, with fuel pressure in second control chamber 324 being same as the fuel pressure in control body cavity 306, the fuel pressure forces acting on control body 304 in combination with the biasing force of spring 346, keeps the control body 304 in the closed position blocking fuel flow though throttled return channel 216, and throttled passage 318.

At predetermined times during engine operation, injection control valve 400 is actuated by host controller module 110 to controllably move pilot valve 214 from the closed position (as shown) to the open position thereby allowing fuel flow from throttled return channel 216 to low pressure drain circuit 212. As a result, pressure in second control chamber 324 decreases thereby allowing fuel flow from first control chamber 322 to second control chamber 324 via throttled passage 318. Simultaneously, a very small amount of high pressure fuel flows from control body cavity 306 into first control chamber 322 through annular guiding clearance 350, but not enough to equalize the pressure deferential between first control chamber 322 and control body cavity 306. The relative size of return channel orifice 260 (FIG. 2), and orifice 320 (FIG. 3) of control body 304 can be selected to optimize the flow out drain circuit 212 which in turn will increase or decrease the rate of pressure drop first control chamber 322 pressure, and second control chamber 324 pressure, and control opening rate of nozzle valve 210. As the fuel pressure in first control chamber 322 decreases, fuel pressure forces acting on nozzle valve 210 move nozzle valve 210 upward against bias force of nozzle spring 222 into the open position, thereby injecting fuel into combustion chamber 104 through nozzle orifice 206. Since the pressure in first control chamber 322 is higher than second control chamber 324, the fuel pressure forces acting on control body 304 together with biasing force of spring 346 pushes control body 304 up against support 230, in the closed position. When the high pressure fuel passes through the nozzle orifices 206, the high pressure fuel is atomized and diffused, thereby being brought into a state where the fuel is easily mixed with air for combustion.

Upon de-actuation of injection control valve 400, pilot valve 214 moves back into the closed position thereby restricting fuel flow to drain circuit 212, and pressurizing first control chamber 322, second control chamber 324, throttled return channel 216, and throttle passage 318. Due to momentum, nozzle valve 210 continues to move upward along the longitudinal axis 228 further pressurizing first control chamber 322, second control chamber 324, throttled return channel 216, and throttle passage 318. Fuel pressure forces acting on control body 304, due to differential area between third diameter 352 of control body and second diameter 338 of annular seal 312, begin to move the control body 304 downward along longitudinal axis 228 against the biasing force of spring 346 into the open position, allowing fuel flow from control body cavity 306 to first control chamber 322 through second control chamber 324, and throttled passage 318. The size of orifice 320 can be selected to optimize the flow rate from second control chamber 324 to first control chamber 322 which in turn will increase the pressure in first control chamber 322 and control the closing rate of the nozzle valve 210. Fuel pressure forces acting on nozzle valve 210 along with the biasing force of nozzle spring 222 will begin to move nozzle valve 210 downward along longitudinal axis 228 into the closed position, restricting fuel flow into combustion chamber 104 and ending the injection event. Simultaneously, as fuel continues to flow from nozzle cavity 204 into control body cavity 306 through inlet passage 302, and from control body cavity 306 to first control chamber 322 through second control chamber 324 and throttled passage 318, the control body 304 is forced to move upward along the longitudinal axis 228 into the closed position and the fuel pressure equalizes. At this point fuel injector 200 is ready for next injection event.

While the embodiments have been described as having exemplary designs, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this invention pertains.

The invention claimed is:

1. A fuel injector, comprising:

an injector body having a longitudinal axis, an injector cavity, an injector orifice at a distal end of the injector cavity, and an inlet conduit configured to supply fuel into the injector cavity;

a nozzle valve in the injector cavity;

a drain circuit configured to drain fuel from the injector cavity to a low pressure drain;

a pilot valve in flow communication with the drain circuit;

a chamber housing having an inlet passage to receive fuel from the injector cavity, a return port in flow communication with the pilot valve to drain fuel to the drain circuit, and an abutting surface surrounding the return port; and a control body slidably disposed in the chamber housing, the control body having, a distal end, a proximal end, and a longitudinal axis parallel with the injector body longitudinal axis, a first depression at the distal end of the control body defining a first control chamber in which one end of the nozzle valve is guided, a second depression at the proximal end of the control body defining a second control chamber in flow communication with the return port, and an annular seal disposed radially of the second depression having a first diameter at an inner surface and a second diameter at an outer surface, wherein the first diameter is smaller than the second diameter, wherein the annular seal of the control body seals against a support body when the control body is in a closed position and the control body disengages from the support body in an open position.

2. The fuel injector of claim 1, wherein the control body further includes a throttled passage extending from the distal end of the control body to the proximal end of the control body connecting the first control chamber with the second control chamber.

3. The fuel injector of claim 2, wherein the throttled passage further includes a control body orifice configured to control a closing rate of the control body and a closing rate of the nozzle valve.

4. The fuel injector of claim 1, wherein the control body further includes a protrusion on an outer surface of the control body configured to control axial movement of the control body along the injector body.

5. The fuel injector of claim 4, wherein an inner surface of the chamber housing further includes a shoulder below the protrusion of the control body and the inlet passage, the shoulder configured to control the movement of the control body along the longitudinal axis.

6. The fuel injector of claim 5, further including a spring positioned in the chamber housing between the protrusion and the shoulder.

7. The fuel injector of claim 1, wherein the chamber housing is disposed between a nozzle sleeve, the nozzle valve, and the pilot valve, the chamber housing being positioned in abutment against the nozzle sleeve restricting fuel flow, and the nozzle valve having a close sliding fit with an inside surface of the nozzle sleeve.

8. The fuel injector of claim 1, wherein the control body defines an annular guiding clearance at the distal end of the control body between an outer surface of the control body and an inner surface of the chamber housing.

9. The fuel injector of claim 1, wherein the control body has a third diameter at the distal end of the control body which is greater than the second diameter.

10. The fuel injector of claim 1, wherein the inlet passage is throttled.

11. A fuel system, comprising:

a fuel tank communicating with a high pressure generating module;

a fuel injector;

a fuel supply channel extending between the high pressure generating module and the fuel injector; and a return channel extending between the fuel injector and the fuel tank;

wherein the fuel injector includes an injector body having a longitudinal axis, an injector cavity, an injector orifice at a distal end of the injector cavity, and an inlet conduit configured to supply fuel into the injector cavity, a nozzle valve in the injector cavity, a drain circuit configured to drain fuel from the injector cavity to a low pressure drain, a pilot valve in flow communication with the drain circuit, a chamber housing having an unrestricted inlet passage to receive fuel from the injector cavity, a return port in flow communication with the pilot valve to drain fuel to the drain circuit, and an abutting surface surrounding the return port, and a control body slidably disposed in the chamber housing, wherein the control body having a distal end, a proximal end, and a longitudinal axis parallel with the injector body longitudinal axis, a first depression at the distal end of the control body defining a first control chamber in which one end of the nozzle valve is received, a second depression at the proximal end defining a second control chamber in flow communication with the return port, and an annular seal disposed radially of the second depression having a first diameter at an inner surface and a second diameter at an outer surface, wherein the first diameter is smaller than the second diameter.

12. The fuel system of claim 11, wherein the control body further includes a throttled passage extending from the distal end of the control body to the proximal end of the control body connecting the first control chamber with the second control chamber.

13. A method, comprising:

energizing a fuel injector pilot valve thereby causing a sealing element to open resulting in a pressure differential between a first control chamber and an injector cavity to a level which enables a nozzle valve to move upward toward an open position and begin a fuel injection event;

de-energizing the pilot valve thereby causing the sealing element to close while the nozzle valve continues to move upward pressurizing a second control chamber to a level which enables a control body to open relative to the sealing element and permit fuel to flow from the injector cavity to the second control chamber, the control body having a distal end, a proximal end, and a first depression at the distal end of the control body defining the first control chamber in which one end of the nozzle valve is received;

ending the fuel injection event when the nozzle valve closes in response to a pressure differential between the first control chamber, the second control chamber, and the injector cavity; and closing the control body in response to a drop in pressure differential between the injector cavity and the second control chamber.

14. The method of claim 13, wherein applying a biasing force to the control body to open relative to the sealing element by providing an annular seal at a proximal end of the control body.

15. A fuel injector, comprising:

an injector body having a longitudinal axis, an injector cavity, an injector orifice at a distal end of the injector cavity, and an inlet conduit configured to supply fuel into the injector cavity;

a nozzle valve in the injector cavity;

a drain circuit configured to drain fuel from the injector cavity to a low pressure drain;

a pilot valve in flow communication with the drain circuit;

a chamber housing having an inlet passage to receive fuel from the injector cavity, a return port in flow communication with the pilot valve to drain fuel to the drain circuit, and an abutting surface surrounding the return port; and a control body slidably positioned in the chamber housing, the control body having a distal end, a proximal end, and a first depression at the distal end of the control body defining a first control chamber in which one end of the nozzle valve is received the nozzle valve is received; the control body further includes, a longitudinal axis parallel with the injector body longitudinal axis, a second depression at the proximal end of the control body defining a second control chamber in flow communication with the return port, and an annular seal disposed radially of the second depression having a first diameter at an inner surface and a second diameter at an outer surface, wherein the first diameter is smaller than the second diameter.

16. The fuel injector of claim 15, wherein the control body further includes a throttled passage extending from the distal end of the control body to the proximal end of the control body connecting the first control chamber with the second control chamber.

17. The fuel injector of claim 16, wherein the throttled passage further includes a control body orifice configured to control a closing rate of the control body and an opening rate of the nozzle valve.

18. The fuel injector of claim 15, wherein the control body further includes a protrusion on the outer surface configured to control axial movement of the control body along the injector body.

19. The fuel injector of claim 15, wherein the chamber housing is disposed between a nozzle sleeve, the nozzle valve, and the pilot valve, the chamber housing being positioned in abutment against the nozzle sleeve restricting fuel flow, and the nozzle valve having a close sliding fit with an inside surface of the nozzle sleeve.

20. The fuel injector of claim 19, wherein an inner surface of the chamber housing further includes a shoulder below the protrusion of the control body and the inlet passage, the shoulder configured to control the movement of the control body along the longitudinal axis.

21. The fuel injector of claim 20, further including a spring positioned in the chamber housing between the protrusion and the shoulder.

22. The fuel injector of claim 15, wherein the control body defines an annular guiding clearance at the distal end of the control body between the outer surface of the control body and an inner surface of the chamber housing.

23. The fuel injector of claim 15, wherein the inlet passage is throttled.

* * * * *